US005707032A

United States Patent [19]

Ehrlich

[11] Patent Number: 5,707,032

[45] Date of Patent: Jan. 13, 1998

[54] TABLE SKIRT-ATTACHING HANGER

[76] Inventor: Paul Ehrlich, 241 Mill St., Lawrence, N.Y. 11559

[21] Appl. No.: 786,412

[22] Filed: Jan. 21, 1997

[51] Int. Cl.[6] ..... A47B 13/16

[52] U.S. Cl. ..... 248/205.3; 248/300; 160/368.1

[58] Field of Search ..... 248/205.3, 300, 248/309.1; 40/594, 661.09; 150/158; 160/38, 368.1; 108/90

[56] References Cited

U.S. PATENT DOCUMENTS

| | | | |
|---|---|---|---|
| 3,884,443 | 5/1975 | McMaster | 40/594 X |
| 4,708,183 | 11/1987 | Figueroa | 108/90 X |
| 4,736,917 | 4/1988 | Thuresson | 248/205.3 |
| 4,832,301 | 5/1989 | Hiramoto | 248/205.3 X |
| 5,328,137 | 7/1994 | Miller et al. | 248/205.3 X |

*Primary Examiner*—Peter R. Brown
*Attorney, Agent, or Firm*—Myron Amer P.C.

[57] ABSTRACT

For attaching a decorative skirt about the peripheral edge of a banquet table, a one-use disposable plastic hanger advantageously coated during a production run on a single side over side and top length portions in surrounding relation about a pivotal tab with adhesive, such that in use adhesive on the noted length portions are adhesively attached to the table edge and the tab, after a 270 degree pivotal transverse, is in an outwardly facing relation from the table edge and thus in position to complete an adhesive attachment to the decorative skirt.

1 Claim, 1 Drawing Sheet

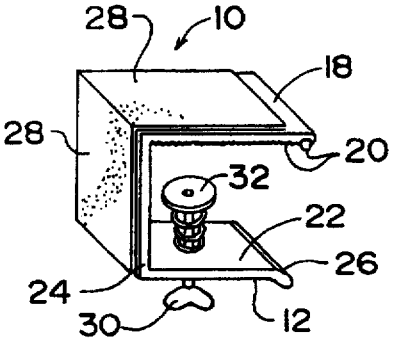
FIG. 1 PRIOR ART
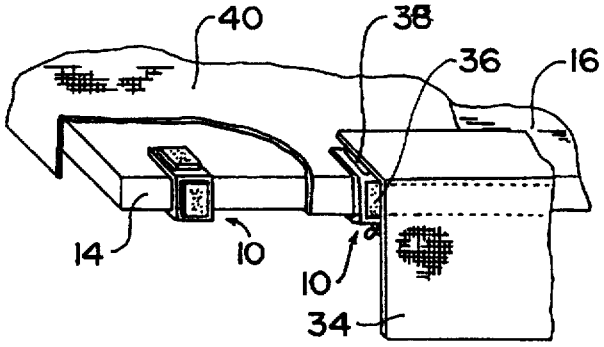
FIG. 2
PRIOR ART
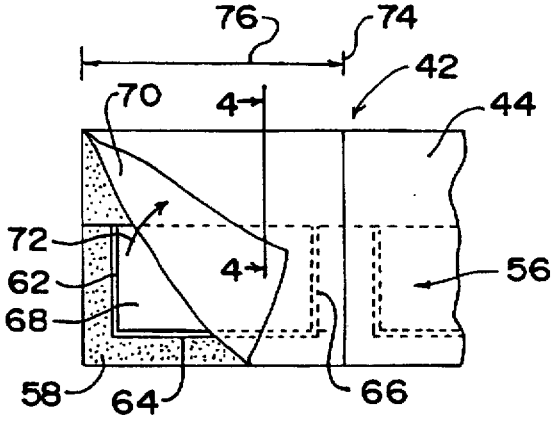
FIG. 3
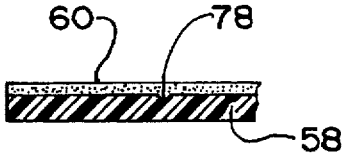
FIG. 4
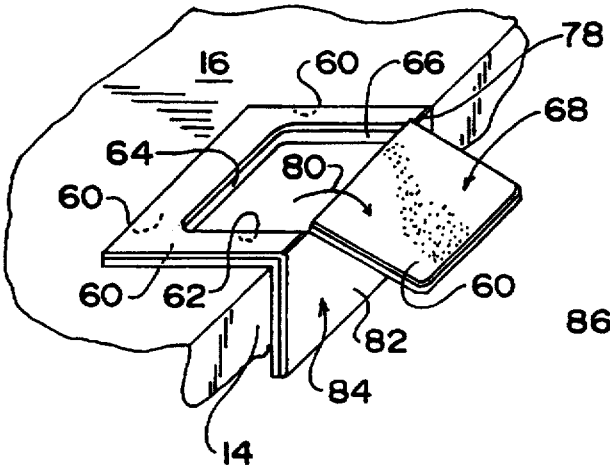
FIG. 5
FIG. 6
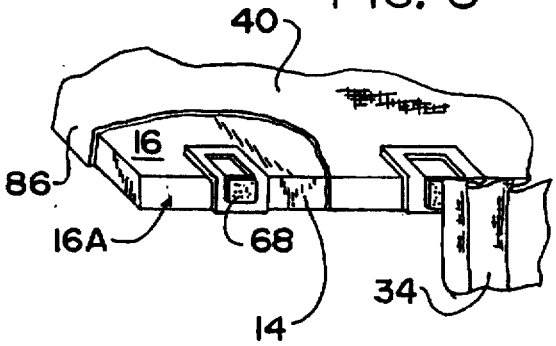

TABLE SKIRT-ATTACHING HANGER

The present invention relates generally to applying a decorative skirt to a banquet or similar table to mask the legs thereof as well as enhance its appearance with the color, pleats or other features of the attached skirt, and more particularly to improvements in the use of table-attaching hangers in achieving the suspension of the skirt about the peripheral edge of the table.

EXAMPLE OF THE PRIOR ART

It is already well known, as exemplified by U.S. Pat. No. 4,708,183 issued on Nov. 24, 1987 to Figueroa, that interengaging velcro patches and strips serving as hangers are an effective means of removably attaching a decorative skirt to a table. In Figueroa, the hangers are plastic clips with velcro patches that are strategically located about the table edge and a velcro strip sewn or otherwise secured along the top of the decorative skirt is engaged to the patches on the previously positioned hangers to complete the application of the skirt to the table.

The prior art above noted hangers do not always remain attached to the table edge after the skirt is removed for cleaning or the like, and thus often are misplaced. And, if applied with sufficient gripping pressure to avoid shifting in position and to remain attached to the table, the grips of the hangers might mar the surface of the table.

Generally, it is an object of the present invention to provide a table skirt-attaching hanger overcoming the foregoing and other shortcomings of the prior art. Specifically, it is an object to use as a support for hanging the skirt in encircling relation about the peripheral edge of the banquet table a plastic article of manufacture that has an adhesive deposit readily applied to one surface and, in use, is operatively effective to present this single adhesive deposit in differing or opposing directions so that functionally two adhesive attachments can be made, one to the banquet table and the other to the skirt, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

In preparing a smorgasbord table typically used at a wedding, banquet or like social function, use is made of attaching clips and velcro to suspend a decorative skirt about the table, one such attaching clip exemplifying the prior art being shown in FIG. 1 in a perspective view;

FIG. 2 is similarly a perspective view showing, more particularly, the clip of FIG. 1 in its intended use;

The remaining figures illustrate an improved table skirt support or hanger according to the present invention in which FIG. 3 is a partial plan view of a plastic strip out of which the within hangers are cut to width as articles of manufacture;

FIG. 4 is a sectional view, on an enlarged scale, as taken along line 4—4 of FIG. 3;

FIG. 5 is a partial perspective view of the hanger; and

FIG. 6 is another partial perspective view illustrating the hangers in their skirt-supporting intended end use.

To better understand the patentable advance of the within table skirt-attaching hanger, it is helpful to compare it to the prior art practice illustrated in FIGS. 1 and 2. More particularly shown in these figures is a prior art retainer device or plastic clip 10 having a generally C-shaped body 12 by which it is adapted to clamp on the edge 14 of a banquet or similar table top 16. Body 12 has an upper horizontally oriented leg 18 with gripping ridges 20 on its undersurface, and is connected to a lower horizontally oriented bottom leg 22 with a slip-over edge 26 and rear wall 24. The exterior surfaces of the leg 18 and connecting wall 24 have adhesively attached patches 28 of velcro hook material. Centrally disposed on leg 22 is a spring biased pin 30 which presses a washer 32 against the underside of table top 16 when clip 10 is in use.

In FIG. 2 demonstrating the use of the clips 10, they are shown clamped to an uncovered table top 16. A table-decorating skirt 34, with strips 36 and 38 of velcro loop material stitched or adhesively secured thereon, is typically in turn secured directly to velcro hook patches 28 on the spaced-apart clips 10 located along table edge 14 when a table cover 40 is not used. When a cover 40 is used, a sufficient number of clips 10 are used to clip the cover 40 to table top 16, and the skirt 34 is added as shown in FIG. 2.

The prior art clips 10 may inadvertently mar the table 14 at the pressure locations of the washers 32, and a more significant shortcoming is that the clips 10 often are misplaced because they readily detach from the table. To obviate the foregoing and other shortcomings, the within table skirt support system, shown in FIGS. 3–6 uses an article of manufacture, generally designated 42, of plastic construction material, in the manufacture of which a plastic strip 44 is urged in a lengthwise or machine direction 56 and has deposited on an attaching surface 58 an appropriate adhesive coating 60, is die-cut at three cooperating locations 62, 64 and 66 to delineate a three-sided inboard-directed die-cut table skirt-attaching tab 68, and has applied in covering relation over the attaching surface 58 a release strip 70 which prevents inadvertent adhesive attachments until the release strip 70 is peeled in the direction 72. The strip 44 is die cut at spaced intervals, as at 74, to cut to width 76 the individual hangers. To facilitate a folding traverse of the tab 68, as will soon be explained, the processing of the strip 44 includes forming a recess or notch 78 at the base of the tab 68.

As best shown in FIG. 5, the hanger 42 is oriented relative to the table 16, then covered with a cloth 40 or not, so that the adhesive coat 60 is in facing relation therewith. The adhesive coat 60 which surrounds the tab 68 on the length portions of the plastic separated by the die cuts 62, 64 and 66, are used to establish an adhesive attachment to the top 16 of the table 16A, and the remaining length portion beyond the folding notch 78 is used to establish an adhesive attachment to the side edge 26 of the table 16A.

Either subsequent to or prior to the two established adhesive attachments noted, the tab 68 is moved into a ready position incident to an initial pivotal traverse in the direction 80 so as to avoid attachment to the table top 16 and, from its ready position, the tab is urged through a full pivotal traverse 80 completing its movement out of the plane of the body of the hanger into a clearance position removed therefrom, in which it is adjacent the uncoated surface 82 of the hanger portion 84. In this clearance position of movement it should be readily appreciated that the adhesive coat 60 on the tab 68 is in an advantageous outwardly facing relation from the table edge 14, and thus presents the adhesive 60 to facilitate establishing an adhesive attachment to the table skirt 34.

Underlying the present invention is the recognition that, to provide an intended one-use disposable function or utility to the hanger 42, the manufacture thereof must be consistent with economical mass production techniques. This is achieved by the application of the adhesive coat 60 on the one surface 58 and thus during one production run of the plastic strip 44, and nevertheless achieving a two-directional orientation of the adhesive coat 60 for attachment purposes, i.e. in one direction in facing relation to the table top 16 and in a ninety degree second direction in outwardly facing relation to the table edge 14, said two-directional orientation of the adhesive coat 60 being the result of the 270 degree pivotal traverse 80 of the tab 68 out of the plane of the hanger 42.

As best understood from FIG. 6, the user has the option of attaching the hanger 42, as exemplified by the hanger on the left, directly to the table top and edge 16, 14, attaching the skirt 34 thereto (not shown), and allowing the border 86 resulting from the size difference between the tablecloth 40 and the table top 16 to drape over the top of the attached skirt 34. Alternatively, the hanger 42, as exemplified by the hanger on the right, is attached on top of the table cloth 40 and border 86, and the skirt 34 attached to the tab 68, the exposed portion of the hanger being only a nominal distraction because of its size of only approximately one and one half inches and the plural hangers being widely spaced apart.

After the wedding or other occasion of use, the hangers 42 are readily detached from the table 16A and, being nominally priced, are typically discarded.

While the particular table skirt-attaching hanger herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. An improved hanger which attaches a decorative table skirt to a banquet table, said hanger being of a one-use disposable type produced as an article of manufacture consisting of plastic construction material, said hanger article of manufacture comprising a die-cut strip from said plastic further die-cut lengthwise at selected spaced locations therealong to delineate therefrom plural said table-skirt hangers, each said hanger having a three-sided inboard-directed die-cut table skirt-attaching tab, an adhesive coat in covering relation over one side of each said hanger, a selected number of said hangers having operative positions in spaced relation inwardly along an edge of said banquet table incident to adhesive contact of said adhesive coats thereof to said banquet table, and each of said table skirt-attaching tabs are adapted to move pivotally from a position that is coplanar with the remainder of said hanger to an operative position which extends outwardly from the remainder of said hanger for positioning said adhesive coats on said tabs in outwardly facing relation to said banquet table, whereby said decorative banquet table skirt is temporarily adhesively attached to said tabs preparatory to the use thereof with said banquet table and subsequently readily removed for disposal.

* * * * *